United States Patent [19]

Simpson, Jr. et al.

[11] Patent Number: 5,046,445

[45] Date of Patent: Sep. 10, 1991

[54] BOAT HAVING A COMPOSITE V-SHAPED FOAM BLOCK BOTTOM STRUCTURE.

[76] Inventors: George D. Simpson, Jr.; George D. Simpson, Sr., both of Rte. 1, Box 315, Beaufort, N.C. 28516

[21] Appl. No.: 559,720

[22] Filed: Jul. 30, 1990

[51] Int. Cl.[5] ..... B63B 5/24

[52] U.S. Cl. ..... 114/357

[58] Field of Search ..... 114/355, 356, 357, 56, 114/57, 358

[56] References Cited

U.S. PATENT DOCUMENTS 3,070,817 1/1963 Kohrn et al. ..... 114/357
4,032,689 6/1977 Johnson et al. ..... 114/357
4,128,072 12/1978 Wood ..... 114/56
4,495,884 1/1985 Stark ..... 114/357

FOREIGN PATENT DOCUMENTS 131482 10/1981 Japan ..... 114/357

*Primary Examiner*—Sherman D. Basinger
*Assistant Examiner*—Stephen P. Avila
*Attorney, Agent, or Firm*—Rhodes, Coats & Bennett

[57] ABSTRACT

The present invention relates to a boat having a v-shaped composite foam block bottom structure. Forming a part of the boat bottom structure is a v-shaped bottom hull panel and disposed thereover is a plurality of transversely extending v-shaped foam blocks that are laminated to the bottom panel through a fiberglass bonding network.

6 Claims, 4 Drawing Sheets

BOAT HAVING A COMPOSITE V-SHAPED FOAM BLOCK BOTTOM STRUCTURE

FIELD OF THE INVENTION

The present invention relates to boats and more particularly to boats having foam blocks forming a part of the bottom structure of the boat.

BACKGROUND OF THE INVENTION

Boats using a foam block design are in extensive use in many sporting and commercial endeavors. These foam block designs are presently incorporated in several flat bottom boat hull designs. Typically, the foam block assembly is placed in a flat configuration adjacent to the flat bottom hull with the foam blocks being adhered flatly to this bonding surface by a laminating process.

However, in use, these flat bottom boat hulls have had a tendency to buckle inwardly and be displaced upwardly by the force of water acting against the bottom surface of the hull. In the past, this buckling and flexing action has resulted in the foam blocks being delaminated from their previously bonded position, resulting in delamination. This tendency for delamination exerts great stress on the hull and seriously weakens the structural design, and can place the entire boat structure and its integrity in jeopardy. In addition, it is not unusual for the flat bottom in its entirety to peel away from the hull.

Therefore, there is and continues to be a need for a boat design of a type with a foam block construction that is strong, durable, and that can overcome the inherent disadvantages commonly associated with the typical flat bottom boat hull that incorporates foam blocks.

SUMMARY AND OBJECTS OF THE INVENTION

The present invention entails a foam block boat hull structure wherein there is provided a composite v-shaped bottom structure that is made up of a bottom v-shaped hull panel and a series of transversely extending v-shaped foam blocks that are bonded to the boat hull panel by a network of fiberglass laminate sheets. Of particular importance is the strength and rigidity achieved by the combined v-shaped design of the foam blocks and the bottom boat panel in combination with the fiberglass laminates, particularly a v-shaped fiberglass laminate wall or sheet that extends vertically between between respective foam blocks and a horizontal v-shaped laminate sheet that extends between the foam blocks and the bottom v-shaped hull panel. Due to that total structure, the bottom of the boat resists vertical movement or displacement and yields a high degree of strength for the entire boat structure and particularly the bottom of the boat.

It is therefore an object of the present invention to provide a foam block type boat structure that includes a bottom composite structure that is strong and durable and which resists buckling and delamination.

A further object of the present invention resides in he provision of a foam block boat structure that imparts a smooth ride and which is stable and responsive when moving through the water.

Other objects and advantages of the present invention will become apparent and obvious from a study of the following description and the accompanying drawings which are merely illustrative of such invention.

DETAILED DESCRIPTION OF THE INVENTION

Figure 1:
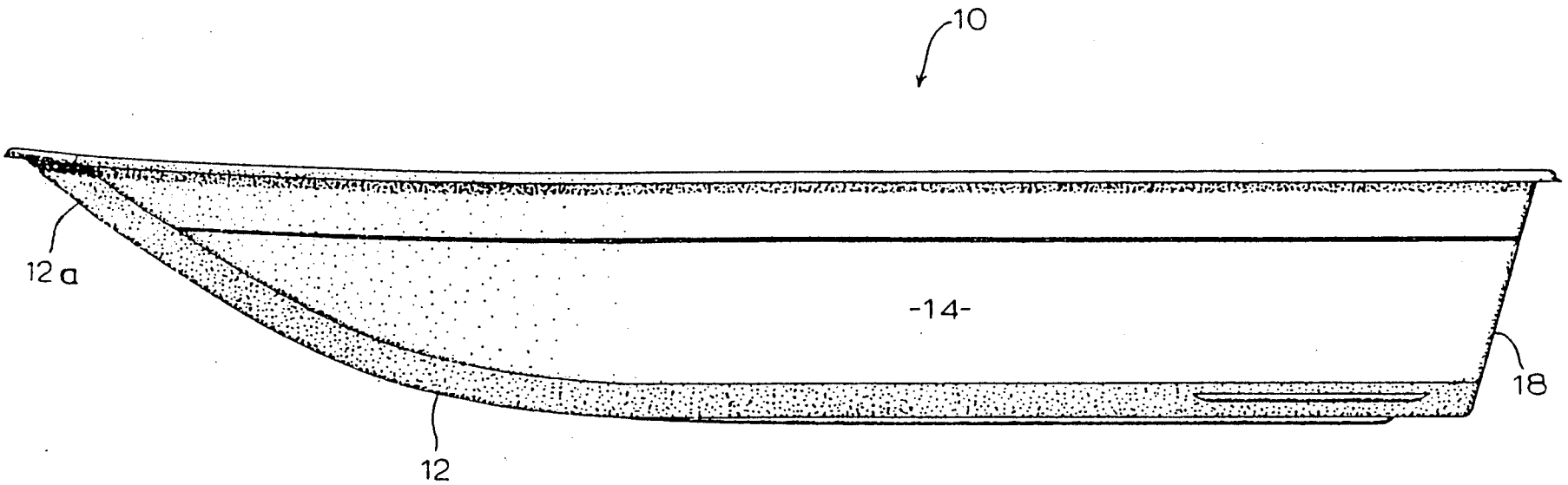
FIG. 1 is a side elevational view of the boat structure of the present invention.
Figure 2:
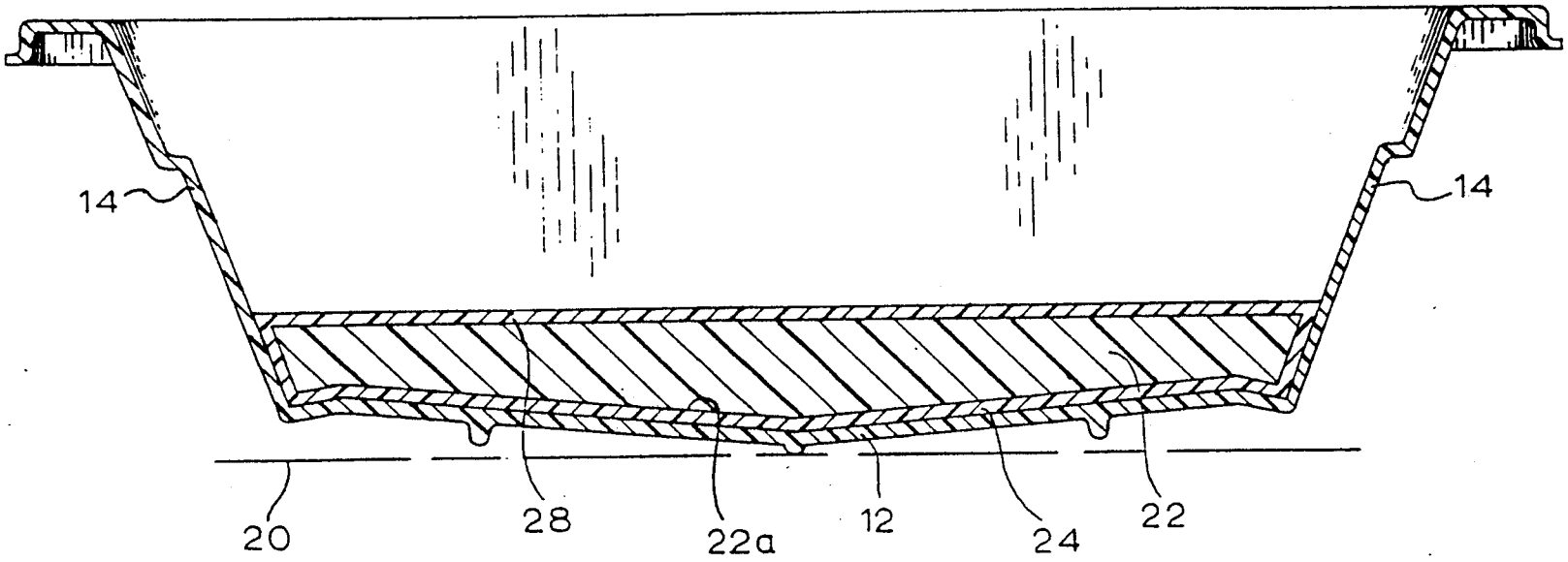
FIG. 2 is a transverse sectional view of the boat structure of the present invention.

With further reference to the drawings, the boat structure of the present invention is shown therein and indicated generally by the numeral 10. As seen in FIG. 1, boat 10 comprises a v-shaped bottom panel 12, a pair of sides 14, a back 18 and a front portion 12*a* that is actually formed by curving the bottom hull panel 12 upwardly. As seen in FIG. 2, the bottom panel 12 is of a v-shape and in the design shown herein, the v-shape forms an angle of approximately 5° with a reference line indicated by the numeral 20.

Figure 3:
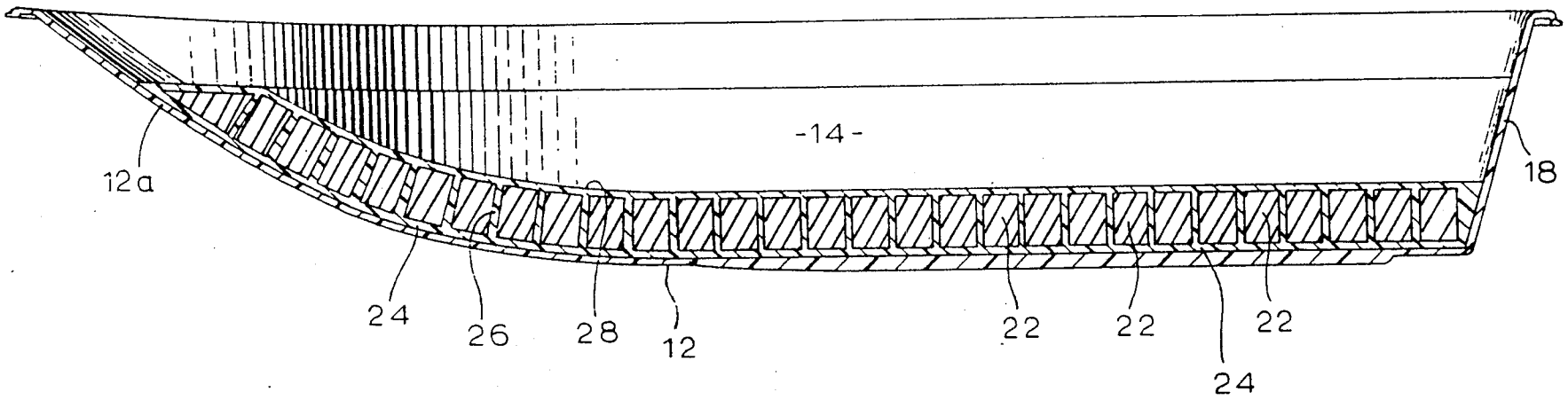
FIG. 3 is a longitudinal sectional view of the boat structure of the present invention.
Figure 4:
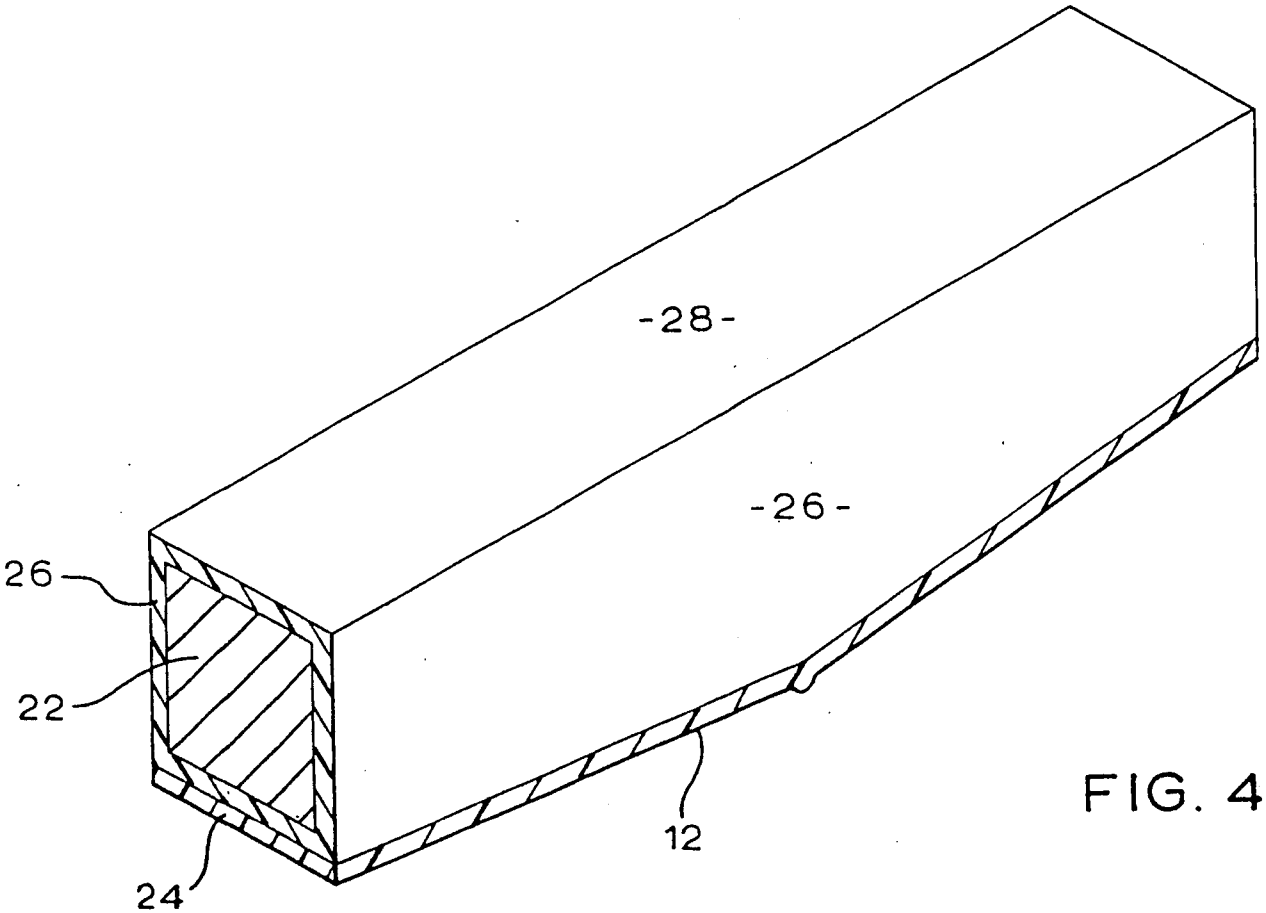
FIG. 4 is a fragmentary perspective view illustrating the relationship of the v-shaped foam block and various fiberglass laminates surrounding the foam block.

To form the bottom structure of the present invention, boat 10 is provided with a series of foam blocks 22 that are disposed transversely across the bottom panel 12 of the boat hull structure. Each foam block 22 includes a bottom portion 22*a* that is also formed in a v-shape to conform to the v-shape of bottom hull panel 12. Essentially, this means that the bottom 22*a* of the foam blocks 22 form an angle of approximately 5°. In a preferred design, this means that the depth of a foam block 22 about its outer extremeties would be approximately five inches while the depth of the foam block at the central point in the boat would be approximately seven and one-half inches. The foam blocks 22 utilized in the present design are of a weight of approximately two pounds per cubic foot and are constructed of polyurethane isocyanate. As seen in FIG. 3, the respective foam blocks 22 are disposed in side-by-side relationship and extend transversely across the bottom of the boat between the respective sides 14. These foam blocks are bonded to the bottom panel 12 of the boat hull through a fiberglass bonding or laminating process. As seen in FIGS. 2 and 3, the individual foam blocks 22 are completely surrounded by a fiberglass laminate structure that effectively ties and bonds the respective foam blocks to the boat structure and particularly to the bottom panel 12. The fiberglass lamination network surrounding the foam blocks 22 is sometimes referred to as fiberglass chop strand. The fiberglass chop strand material is preferably sprayed on in sections and is impregnated with polyester resin and is typically applied in two ounce layers which means there is approximately two ounces of fiberglass per square foot of application.

Viewing the fiberglass chop strand that surrounds the respective foam blocks 22 in more detail, it is seen that the fiberglass chop strand network includes a v-shaped bottom layer or sheet 24 that extends continuously across the bottom panel 12 of the boat hull and effectively bonds each foam block 22 to the bottom panel 12. Further, extending between foam blocks 22 is a series of v-shaped vertical layers or sheets 26. Extending across the top of the foam blocks 22 is an upper fiberglass bonding layer or sheet 28. It is seen in FIGS. 2 and 3 that the v-shaped vertical layers 26 extend and interconnect between the v-shaped bottom layer 24 and the upper layer or sheet 28.

Typically, in constructing boat 10 of the present invention, the fiberglass layers are progressively laid from the back of the boat towards the front of the boat. Typically, an L-shaped fiberglass layer is placed in the back and a single foam block 22 is laid thereover. Next, a fiberglass layer is laid over the top of the foam block and down the forward exposed side thereof and then turned to run a relatively short distance along the bottom panel 12. Next, a second foam block 22 is placed adjacent the first foam block and the process is continued towards the forward portion of the boat.

It is appreciated that the total bottom structure forms a composite v-shaped foam block assembly. It is important to appreciate the v-shaped contribution to strength and integrity of the boat. In particular, not only is the bottom of the boat hull 12 shaped in a "V" but also the foam blocks 22 are v-shaped. Also, the v-shaped vertical fiberglass layers 26 and the v-shaped bottom horizontal layer 24 contribute to the overall strength of the boat and particularly the bottom structure thereof. The formed composite foam block structure is less likely to result in the bottom panel 12 moving up and down and effectively causing the foam blocks 22 to become delaminated from the boat structure.

From the foregoing specification and discussion, it is appreciated that the present boat structure is unique inasmuch as the same includes a foam block fiberglass laminate composite structure with the same including numerous integrated v-shaped components that add to the strength, durability and integrity of the boat structure 10 as a whole.

The present invention may, of course, carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A v-shaped foam block boat hull having improved strength properties, comprising: a boat hull having a v-shaped bottom panel; a series of foam blocks supported over the v-shaped bottom panel and extending transversely thereacross; each foam block having a lower v-shaped bottom that corresponds in shape to the v-shaped bottom panel of the boat hull; fiberglass laminate interposed between the foam blocks and the v-shaped bottom panel and between adjacent foam blocks so as to bond the foam blocks together as well as bond the foam blocks to the v-shaped bottom panel; the fiberglass laminate including a series of longitudinally spaced vertical v-shaped fiberglass walls extending upwardly from the v-shaped bottom panel between respective foam blocks; and wherein the foam blocks, bottom v-shaped panel, and the fiberglass laminate form a composite v-shaped bottom boat structure that is strong and durable and which resists buckling and delamination.

2. The v-shaped foam block boat hull of claim 1 wherein both the v-shaped foam blocks and the v-shaped bottom panel form an angle of approximately 5° with respect to a horizontal reference line.

3. The v-shaped foam block boat hull of claim 1 wherein the fiberglass laminate includes a v-shaped bottom laminate sheet that lies between the foam blocks and the v-shaped bottom panel and wherein the v-shaped bottom laminate sheet in conjunction with the vertical v-shaped fiberglass wall extending between the respective foam blocks forms a strong reinforcing bonding configuration within the composite v-shaped bottom structure.

4. The v-shaped foam block boat hull of claim 2 wherein the formed angle of approximately 5° is generally constant from the stern to the bow of the boat.

5. A method of forming a foam block bottom boat comprising:

a) shaping a bottom panel of the boat into a v-shape;

b) forming a series of foam blocks and shaping the foam blocks such that the bottom of the blocks include a v-shaped bottom that conforms to the v-shape of the bottom panel;

c) laminating the v-shaped foam bock to the v-shaped bottom panel and forming a vertical v-shaped laminate wall between adjacent foam blocks and a generally horizontal v-shaped laminate wall between the foam blocks and the v-shaped bottom panel; and d) wherein the above process forms a v-shape composite bottom structure that includes the v-shaped foam blocks, v-shaped bottom panel and v-shaped laminate sheets including the v-shaped vertical wall and the horizontal v-shaped laminate wall.

6. The method of claim 5 including forming the bottom of the foam blocks and bottom panel of the boat hull at an angle of approximately 5° relative to a horizontal reference line.

* * * * *